US010154726B2

(12) United States Patent
Johnston

(10) Patent No.: US 10,154,726 B2
(45) Date of Patent: Dec. 18, 2018

(54) PORTED BRUSH APPLICATOR

(71) Applicant: Milspray LLC, Lakewood, NJ (US)

(72) Inventor: Matthew L. Johnston, Bayville, NJ (US)

(73) Assignee: MILSPRAY LLC, Lakewood, NJ (US)

( * ) Notice: Subject to any disclaimer, the term of this patent is extended or adjusted under 35 U.S.C. 154(b) by 0 days.

(21) Appl. No.: 15/848,210

(22) Filed: Dec. 20, 2017

(65) Prior Publication Data

US 2018/0110314 A1 Apr. 26, 2018

Related U.S. Application Data

(63) Continuation-in-part of application No. 14/589,999, filed on Jan. 6, 2015, now Pat. No. 9,867,456.

(51) Int. Cl.

| | |
|---|---|
| ***A46B 11/00*** | (2006.01) |
| ***A46B 3/12*** | (2006.01) |
| *B65D 47/42* | (2006.01) |

(52) U.S. Cl.

CPC ..... *A46B 3/12* (2013.01); *A46B 11/0031* (2013.01); *A46B 11/001* (2013.01); *A46B 2200/1046* (2013.01); *B65D 47/42* (2013.01)

(58) Field of Classification Search

CPC combination set(s) only.
See application file for complete search history.

(56) References Cited

U.S. PATENT DOCUMENTS 3,378,331 A * 4/1968 Beasley ..... A45D 27/04 132/290
6,161,978 A * 12/2000 Dovellos ..... A46B 11/0041 401/271

* cited by examiner

*Primary Examiner* — David Walczak
(74) *Attorney, Agent, or Firm* — Freeman IP Law LLC; Mark E. Freeman

(57) ABSTRACT

A ported brush applicator that includes a brush with a ferrule; an applicator base cap attached to the brush, where the applicator base cap includes a cap section having a cap opening that is sized and configured for attachment to a container; an applicator base mesa protruding from the cap section and secured within the ferrule, where the applicator base mesa has at least one through-hole and a fluid port having a first end in the brush and a second end in the through-hole.

14 Claims, 5 Drawing Sheets

PORTED BRUSH APPLICATOR

CROSS REFERENCE TO RELATED APPLICATIONS

This application is a continuation-in-part of U.S. application Ser. No. 14/589,999, filed Jan. 6, 2015, which issued as U.S. Pat. No. 9,867,456 B2 on Jan. 16, 2018, which is incorporated by reference in its entirety.

FIELD OF THE INVENTION

The present invention relates to an apparatus for applying a liquid to a surface and, more particularly, to a brush applicator adapted for attachment to a container.

BACKGROUND OF THE INVENTION

Conventional brush applicators used for coating a surface from a container attached to the brush applicator tend to leak because of poor design. In addition, the brush portion of the brush applicator may become damaged when a user tries to remove the brush applicator by grasping the ferrule, if present, or the brush rather than the cap of the brush applicator.

Needed is a brush applicator with a more robust design that will avoid damage to the brush applicator during normal use.

Also needed is a brush applicator that provides a leak-proof method of applying a liquid material to a desired surface.

BRIEF SUMMARY OF THE INVENTION

In one aspect of the present invention, a ported brush applicator comprises a brush, including a plurality of bristles attached to a ferrule, an applicator base cap attached to the brush, the applicator base cap including a cap section having a cap opening sized and configured for attachment to the container; an applicator base mesa protruding from the cap section and secured within the ferrule, the applicator base mesa having at least one tapered through-hole extending from a mesa end surface into the cap opening; and at least one fluid port having a first end in the plurality of bristles and a second end in the at least one tapered through-hole. The fluid port is configured to enable the liquid material to flow from the cap opening, through the applicator base mesa, the at least one fluid port, and into the plurality of bristles.

In another aspect of the invention, an applicator base cap comprises a cap section having a cap opening sized and configured for attachment to a container; an applicator base mesa protruding from the cap section at the mesa base and having a mesa end surface, wherein the applicator base mesa has a substantially wedge shape extending from the mesa base to the mesa end surface; and at least one tapered hole extending from the mesa end surface to the cap opening.

The additional features and advantages of the disclosed invention are set forth in the detailed description that follows, and will be apparent to those skilled in the art from the description or recognized by practicing the invention as described, together with the claims and appended drawings.

BRIEF DESCRIPTION OF THE SEVERAL VIEWS OF THE DRAWINGS

The foregoing aspects, uses, and advantages of the present invention will be more fully appreciated as they become better understood from the following detailed description of the invention, when viewed in conjunction with the accompanying figures.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention.

The present invention relates generally to a brush applicator for a liquid to be applied to a surface, the brush applicator having an internal ported structure for use with an external reservoir of the liquid material.

Figure 1:
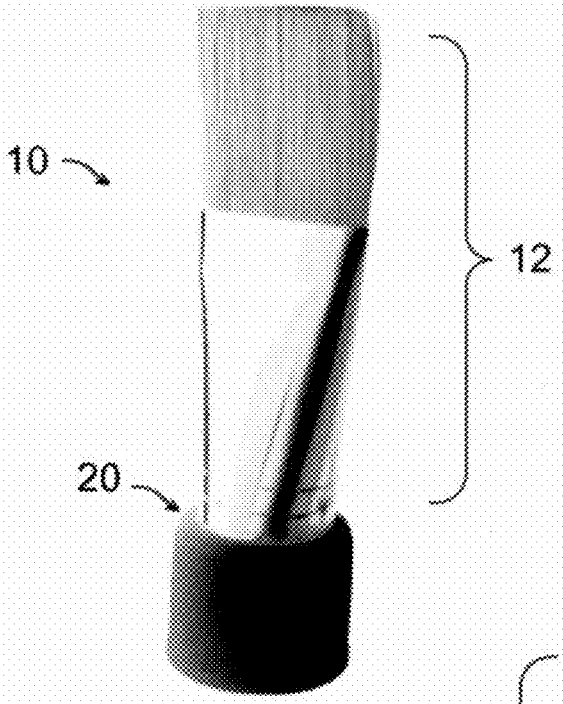
FIG. 1 is a perspective illustration of a ported brush applicator, in accordance with the present invention.

There is shown in FIG. 1 a ported brush applicator 10, in accordance with an aspect of the present invention. The ported brush applicator 10 comprises a brush 12 attached to an applicator base cap 20. The brush 12 is adapted for application of liquid material, such as paint or a sealant. The applicator base cap 20 may be adapted for attachment to a container holding the liquid material (container not shown).

Figure 2:
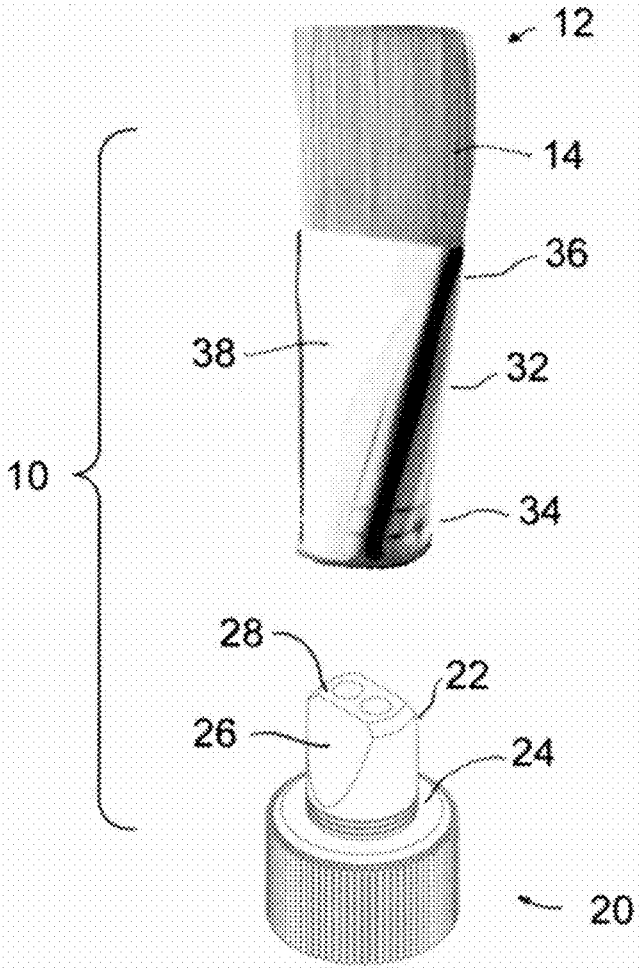
FIG. 2 is an exploded view of the ported brush applicator of FIG. 1 showing a brush and a diagrammatical illustration of an applicator base cap.

FIG. 2 shows an exploded isometric view of the ported brush applicator 10. The brush 12 includes a plurality of bristles 14 retained in an otherwise hollow ferrule 32. The ferrule 32 may be generally cylindrical in shape at a ferrule cap end 34, and generally flattened in shape at a bristle end 36. The ported brush applicator 10 may be fabricated by mechanically or chemically securing the ferrule cap end 34 of the ferrule 32 to the applicator base cap 20.

The brush applicator base cap 20 includes an applicator base mesa 22 sized and shaped to fit through the ferrule cap end 34 and extend into the ferrule 32. In the particular example shown, the cross-sectional shape of the ferrule 32 comprises a circular shape at the ferrule cap end 34, and an elongated rectangular shape at the bristle end 36. A transition sleeve 38 is a tapered region between the ferrule cap end 34 and the bristle end 36. Accordingly, the applicator base mesa 22 is a substantially solid cylindrical shape at a mesa base 24, with opposed bevel faces 26 at a mesa end surface 28.

In an preferred embodiment, the applicator base mesa 22 has a circular cross-sectional shape. Two bevel surfaces 26 produce a generally wedge-shaped segment terminating at the mesa end surface 28, as shown in FIG. 2. It can be appreciated that the bevel faces 26 are sized and shaped to bear against interior ferrule surfaces 66, shown in FIG. 7, and to prevent rotation of the brush 12 with respect to the applicator base cap 20.

Figure 3:
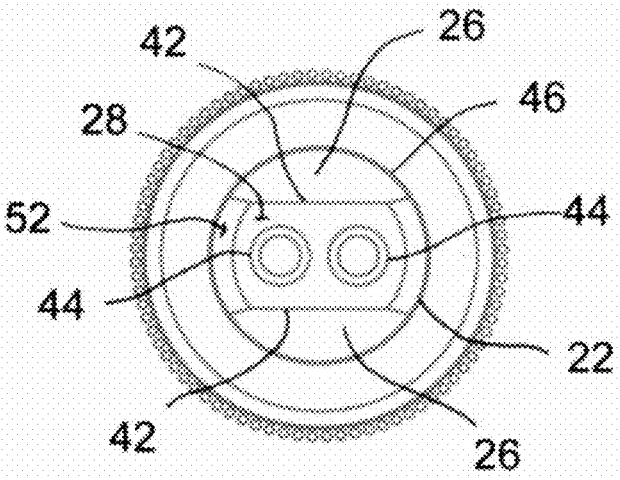
FIG. 3 is a diagrammatical top view of the applicator base cap of FIG. 2.

FIG. 3 is a top diagrammatical view of the brush applicator base 20 showing that the applicator base mesa 22 includes a mesa base 24 that generally is configured as a round cylinder bounded by a cylindrical mesa surface 46, a configuration that enables insertion of the applicator base mesa 22 into the round opening of the ferrule 32. In this view, it can be seen that each of the two bevel faces 26 defines a chord 42 on the mesa end surface 28 of the applicator base mesa 22.

Figure 6:
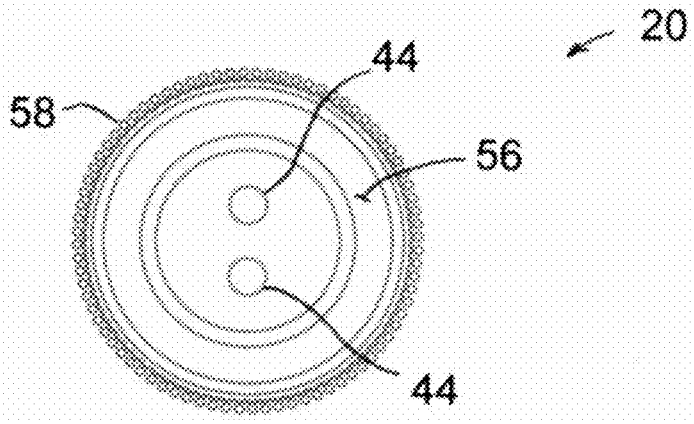
FIG. 6 is a diagrammatical bottom view of the applicator base cap of FIG. 2.

Optional mesa chamfers 52 may be formed between the two chords 43, where the mesa chamfers 52 serve to aid in the manufacturing process of inserting the application base mesa 22 into the ferrule 32. The mesa end surface 28 includes two tapered holes 44 positioned between the two chords 42 and originating in the mesa end surface 28. As best seen in FIG. 6, below, the two tapered holes 44 extend into the cap opening 56 from the mesa end surface 28.

It should be understood that the present invention is not limited to two bevel faces 26, but that one bevel face or three or more bevel faces (not shown) are within the scope of the invention. The number of bevel faces incorporated also defines the shape of the mesa end surface 28, wherein the number of sides to the polygonal mesa end surface corresponds to the number of bevel faces. It should be understood that just as two bevel faces end to form a rounded elongated or oblong mesa end surface, one or many bevels preferably end to form a rounded semicircular or polygonal, respectively, mesa end surface (not shown). Accordingly, it can be appreciated that one or a plurality of bevel faces 26 are to be sized and shaped to bear against corresponding interior ferrule surfaces 66, analogous to that shown in FIG. 7, to prevent rotation of the brush 12 with respect to the applicator base cap 20.

It also should be understood that the present invention is not limited to the use of two tapered holes, but that two holes having substantially the same diameter throughout their lengths may be employed, and that one tapered hole or one hole having substantially the same diameter throughout its length, and three or more tapered holes or holes having substantially the same diameter throughout their lengths may be provided as desired to convey liquid material between the cap opening 56 and the mesa end surface 28.

Figure 4:
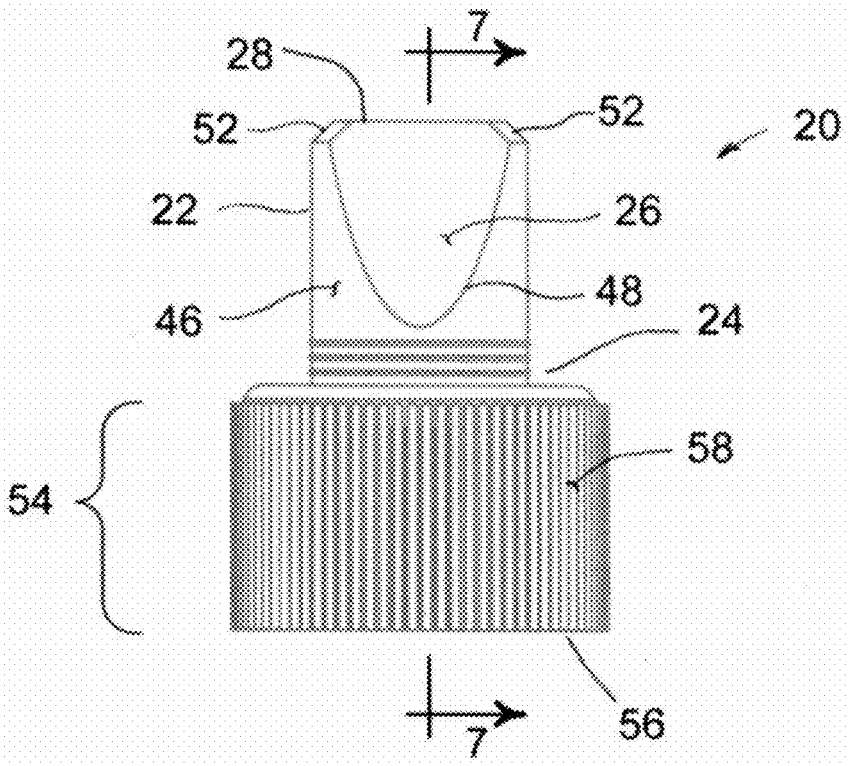
FIG. 4 is a diagrammatical front view of the applicator base cap of FIG. 2.

FIG. 4 is a front view of the applicator base cap 20 showing that the bevel face 26 extends from the mesa end surface 28 to define an elliptical curve 48 in the cylindrical mesa surface 46. In this view, it can be seen that each mesa chamfer 52 also extends between the mesa end surface 28 and the cylindrical mesa surface 46, and may be formed at approximately a 45.degree. angle, as shown. Alternatively, a mesa round configuration (not shown) can be used in place of the flat mesa chamfer 52. A cap section 54, which extends between the mesa base 24 and a cap opening 56 in the applicator base cap 20, may have a knurled surface 58 to enable a user to torque the applicator base cap 20 onto and off the opening of the container holding the liquid material.

Figure 5:
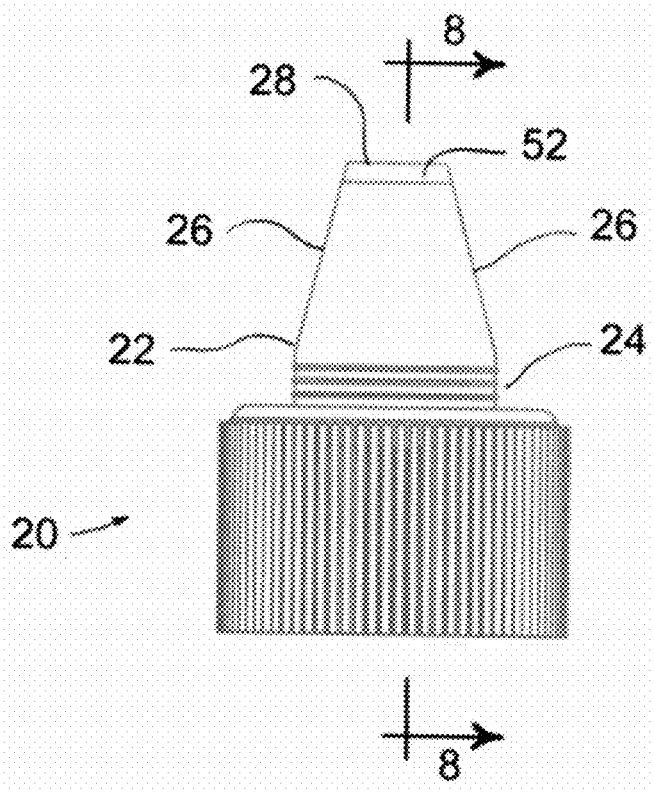
FIG. 5 is a diagrammatical side view of the applicator base cap of FIG. 2.

FIG. 5 is a side view of the applicator base cap 20 showing the bevel face 26 extending from the mesa end surface 28 to the mesa base 24. In this view, it can also be seen that each of the mesa chamfers 52 is bounded by the two bevel faces 26. FIG. 6 is an illustration of the bottom of the applicator base cap 20 where it can be seen that the tapered holes 44, shown in FIG. 3, are through-holes and extend to the cap opening 56 of the applicator base cap 20. The tapered holes 44 and the cap opening 56 enable liquid material to flow from the container to the bristles 14. In an exemplary embodiment, the tapered holes 44 are parallel to one another, and parallel to the axis of the cylindrical mesa base 24.

Figure 7:
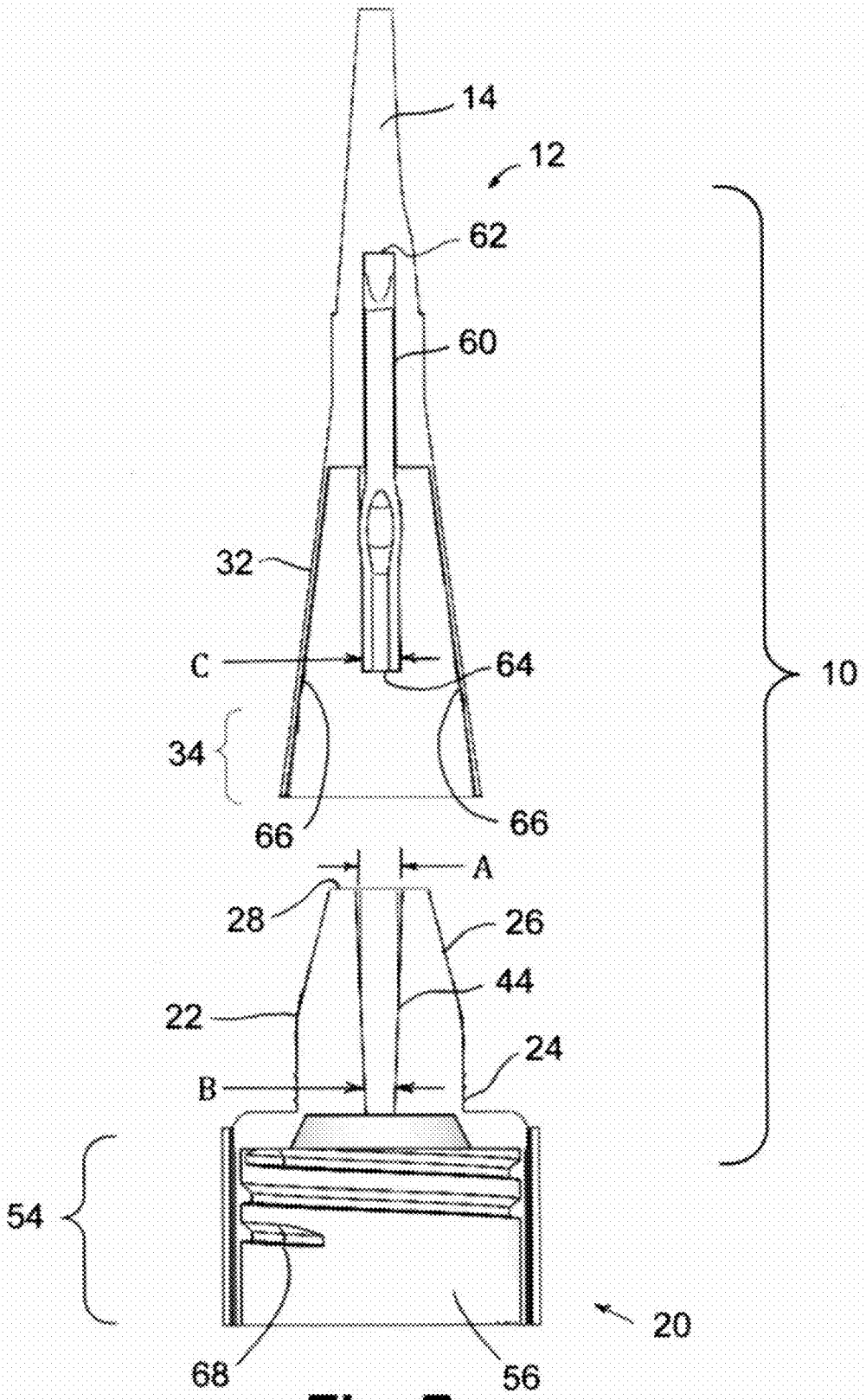
FIG. 7 is an exploded cross sectional side view of the ported brush applicator of FIG. 1.

FIG. 7 is a side sectional view of the ported brush applicator 10, as indicated by the section lines in FIG. 4 that generally pass through the longitudinal axis of the cylindrical mesa base 24. As shown in FIG. 7, the brush 12 includes a pair of fluid ports 60 (one hidden) extending from the interior of the ferrule 32 into the plurality of bristles 14. A bristle port end 62 of the fluid port 60 is disposed in the bristles 14 and a mesa port end 64 of the fluid port 60 is configured for insertion into the corresponding hole 44 in the applicator base cap 20. The one or more fluid ports 60 function to convey the liquid material from the container (not shown and the one or more through-holes 44 within the applicator base cap, into and through the fluid port 60 into the plurality of bristles 14.

The through-hole 44 may have a first diameter, denoted in FIG. 7 as "A," at the mesa end surface 28 of the applicator base mesa 22, and a second diameter, denoted as "B" at the mesa base 24 of the applicator base mesa 22. The fluid port 60 has a diameter, denoted as "C," at the mesa port end 64 of the fluid port 60. In an exemplary embodiment, diameter "A" is larger than diameter "C," and diameter "C" is larger than diameter "B." This configuration insures that the fluid port 60 achieves a tight fit within a tapered hole 44 when the applicator base cap 20 is assembled to the brush 12. This serves to minimize or eliminate the possibility that liquid material may leak around the fluid port 60 and into the ferrule 32 at least for a desired liquid such as paint and/or when the container is inverted and/or the liquid material is compressed, such as by squeezing a compressible container.

The hole 44 in a second exemplary embodiment may alternatively have substantially the same diameter throughout its length, wherein the first diameter denoted as "A," at the mesa end surface 28 of the applicator base mesa 22, and a second diameter, denoted as "B," at the mesa base 24 of the applicator base mesa 22, are substantially the same. By "substantially the same" is meant that a sphere having a diameter A can pass through the length of through-hole 44 having diameter B at mesa base 24 while forming a liquid-tight seal at least for a desired liquid such as paint at normal operating pressures of the ported brush applicator.

In the case of through-hole 44 having substantially the same diameter throughout its length, the fluid port 60 has a diameter, denoted as "C," at the mesa port end 64 of the fluid port 60. Where diameters "A" and "B" are substantially the same and are only slightly larger than diameter "C", while diameter "C" is large enough that fluid port 60 achieves a liquid-tight fit within hole 44 when the applicator base cap 20 is assembled to the brush 12. Indeed, fluid port 60 and the hypothetical rod or sphere noted above may have the same diameters. The relationship between the diameters "A" and "B" relative to diameter "C" serves to minimize or eliminate the possibility that liquid material may leak around the fluid port 60 and into the ferrule 32 when the liquid material container is inverted or slightly pressurized to promote flow of liquid material into the brush 12.

Upon assembly of the ported brush applicator 10, the bevel faces 26 are positioned substantially against the inside ferrule surfaces 66. When the brush 12 is assembled to the applicator base cap 20, the ferrule cap end 34 of the ferrule 32 may be crimped against the mesa base 24 to essentially permanently attach the brush 12 to the applicator base cap 20. The cap section 54 may also include internal threads 68 configured to mate with external threads on the liquid material container (not shown). It can be appreciated that, after assembly, the bevel faces 26 allow the applicator base cap 20 to protrude into the ferrule 32 sufficiently so as to prevent the ferrule 32 from being rotated on the applicator base cap 20 by an applied torque. This insures that a user of the ported brush applicator 10 will not be able to twist and inadvertently separate the brush 12 from the applicator base cap 20 when attempting to twist off the ported brush applicator 10 from the liquid material container.

Figure 8:
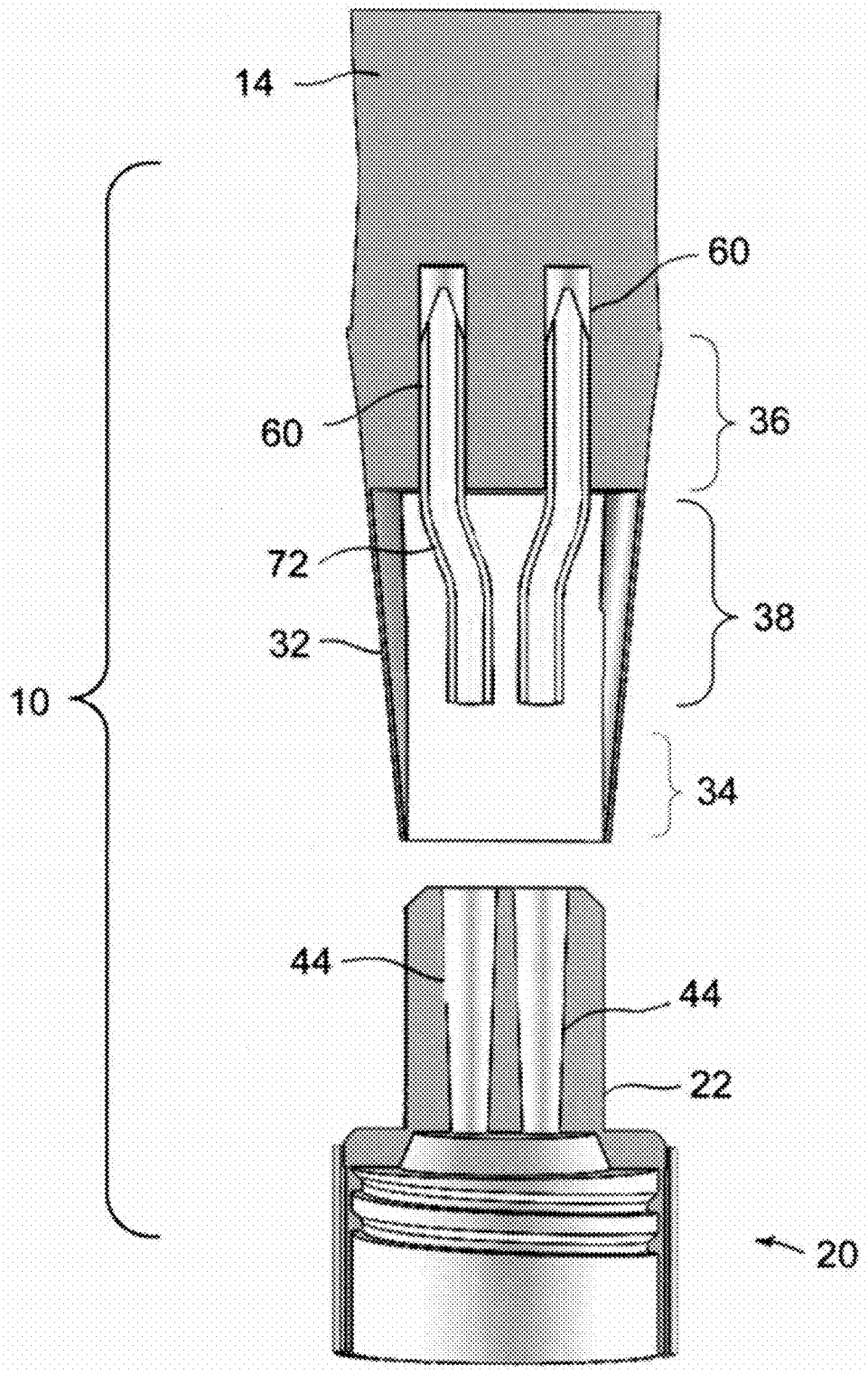
FIG. 8 is an exploded cross sectional front view of the ported brush applicator of FIG. 1.

FIG. 8 shows a front sectional view of the ported brush applicator 10, as indicated by the section lines in FIG. 5. As shown in FIG. 8, an exemplary embodiment may comprise two fluid ports 60 extending from two tapered through-holes 44 in the applicator base mesa 22 of the applicator base cap 20 into the bristles 14 of the brush 12. Alternatively, the two through-holes 44 may have substantially the same diameter throughout their length. Upon assembly of the ported brush applicator 10, the fluid ports 60 are inserted into respective through-holes 44 as the ferrule 32 is placed over the applicator base mesa 22. Although the fluid ports 60 are shown as having offsets or jogs 72, it should be understood that any suitable shape, including linear configurations, can be used in the brush 12.

It is to be understood that the description herein is only exemplary of the invention, and is intended to provide an overview for the understanding of the nature and character of the disclosed ported brush applicators. The accompanying drawings are included to provide a further understanding of various features and embodiments of the method and devices of the invention which, together with their description serve to explain the principles and operation of the invention.

The invention claimed is:

1. A ported brush applicator configured for attachment to a container of liquid material and comprising a brush including a plurality of bristles secured by a ferrule, which has two ends, wherein one of the two ends of the ferrule attaches to an applicator base cap and is generally cylindrical in cross-sectional shape, which tapers to a generally flattened or polygonal shape at the other end of the ferrule that secures the bristles;

the applicator base cap attached to the ferrule, wherein the base cap comprises a cap section having a cap opening sized and configured for attachment to the container;

an applicator base mesa that protrudes from the cap section and extends into the ferrule, wherein the applicator base mesa has at least one through-hole having substantially the same diameter throughout its length and that extends from an end surface of the base mesa nearest the bristles into the cap opening, and wherein the applicator base mesa further comprises two or more beveled faces that protrude into the ferrule and contact a corresponding flattened portion of the ferrule to inhibit rotation of the brush relative to the applicator base cap; and at least one fluid port having a first end in the plurality of bristles and a second end in the at least one through-hole, wherein the fluid port is configured to allow the liquid material to flow from the cap opening, through the applicator base mesa, through the at least one fluid port, and into the plurality of bristles.

2. The ported brush applicator of claim 1, wherein each beveled face defines a chord on the mesa end surface.

3. The ported brush applicator of claim 1, wherein the applicator base mesa comprises two opposing bevel faces that diminish in distance between each other as the faces extend toward the mesa end surface to form a wedge shape that terminates at the mesa end surface.

4. The ported brush applicator of claim 1, wherein the applicator base mesa comprises a substantially flat mesa end surface.

5. The ported brush applicator of claim 4, wherein the at least one through-hole having substantially the same diameter throughout its length wherein the through-hole originates in the mesa end surface.

6. The ported brush applicator of claim 4 comprising two or more through-holes wherein each through-hole has substantially the same diameter throughout its length and wherein each through-hole extends from the mesa end surface into the cap opening.

7. The ported brush applicator of claim 6, wherein the two or more through-holes are substantially parallel to each other.

8. The ported brush applicator of claim 1, wherein the applicator base mesa comprises a mesa base conforming to the shape of the ferrule cap end.

9. The ported brush applicator of claim 8, wherein the cap section comprises internal threads configured to threadably attach the applicator base cap to the container.

10. The ported brush applicator of claim 9, wherein the at least one through-hole having substantially the same diameter throughout its length comprises a longitudinal axis substantially parallel to a longitudinal axis of the mesa base.

11. An applicator base cap for attachment to a container of liquid material, wherein the applicator base cap comprises a cap section having a cap opening sized and configured for attachment to the container;

an applicator base mesa that protrudes from the cap section at a circular mesa base that extends to a mesa end surface, wherein the applicator base mesa comprises one or more bevel faces that terminate at the mesa end surface and form a rounded elongated or oblong or polygonal base mesa surface, wherein the number of sides to the mesa end surface corresponds to the number of bevel faces, and wherein the bevel faces diminish in distance between each other as the faces extend toward the mesa end surface; and at least one through-hole having substantially the same diameter throughout its length extending in a direction substantially perpendicular to the mesa end surface from the cap opening to the mesa end surface.

12. The applicator base cap of claim 11, wherein the applicator base mesa comprises two opposing bevel faces that diminish in distance between each other as the faces extend toward the mesa end surface to form a wedge shape that terminates at the mesa end surface.

13. The applicator base cap of claim 11, wherein the at least one through-hole extends from the cap opening to terminate completely within the oblong mesa end surface.

14. The applicator base cap of claim 11, wherein the cap opening comprises an internal thread.

* * * * *